US012663020B2

(12) United States Patent
Martin et al.

(10) Patent No.: US 12,663,020 B2
(45) Date of Patent: Jun. 23, 2026

(54) TREATMENT OF A NON-AXISYMMETRIC CASING COMPRISING A PLENUM, WITH CONTROLLED OPENING

(71) Applicant: SAFRAN, Paris (FR)

(72) Inventors: Simon Pierre Michel Martin, Moissy-Cramayel (FR); Gabriel Perez, Moissy-Cramayel (FR); William Henri Joseph Riera, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 19/148,982

(22) PCT Filed: Jan. 15, 2024

(86) PCT No.: PCT/FR2024/050055
§ 371 (c)(1),
(2) Date: Jul. 17, 2025

(87) PCT Pub. No.: WO2024/153880
PCT Pub. Date: Jul. 25, 2024

(65) Prior Publication Data

US 2026/0110310 A1 Apr. 23, 2026

(30) Foreign Application Priority Data

Jan. 19, 2023 (FR) ..... 2300514

(51) Int. Cl.
*F04D 29/52* (2006.01)
*F04D 29/56* (2006.01)
*F04D 27/02* (2006.01)

(52) U.S. Cl.
CPC ..... *F04D 29/526* (2013.01); *F04D 29/563* (2013.01); *F04D 27/0246* (2013.01)

(58) Field of Classification Search
CPC .. F04D 29/526; F04D 29/563; F04D 27/0246; F04D 29/685; F04D 27/0215
See application file for complete search history.

(56) References Cited

U.S. PATENT DOCUMENTS 11,346,367 B2 * 5/2022 Yu ..... F04D 29/681
11,572,897 B1 * 2/2023 Duong ..... F04D 29/563
2016/0010652 A1 1/2016 Lim et al.

FOREIGN PATENT DOCUMENTS

EP 4119802 A1 1/2023
JP S62126296 A 6/1987
(Continued)

OTHER PUBLICATIONS

Search Report and Written Opinion issued in International Application No. PCT/FR2024/050055, mailed Apr. 4, 2024.

*Primary Examiner* — Sabbir Hasan
(74) *Attorney, Agent, or Firm* — Bookoff McAndrews, PLLC

(57) ABSTRACT

A casing of a turbine engine compressor including an inner annular wall and an outer annular wall delimiting therebetween an annular cavity. The inner annular wall includes a plurality of slots hollowed out in the thickness of the wall, the slots being arranged next to one another in a circumferential direction and each extending in an axial direction. The casing further includes a sliding ring present in the annular cavity of the casing. The sliding ring is movable in the axial direction between an open position in which the slots in the inner annular wall of the casing open into the annular cavity and a closed position in which the sliding ring covers at least some slots.

8 Claims, 3 Drawing Sheets

(56) References Cited

FOREIGN PATENT DOCUMENTS

| | | | |
|---|---|---|---|
| JP | S62210295 | A | 9/1987 |
| WO | 9420759 | A1 | 9/1994 |

* cited by examiner

[Fig. 1]
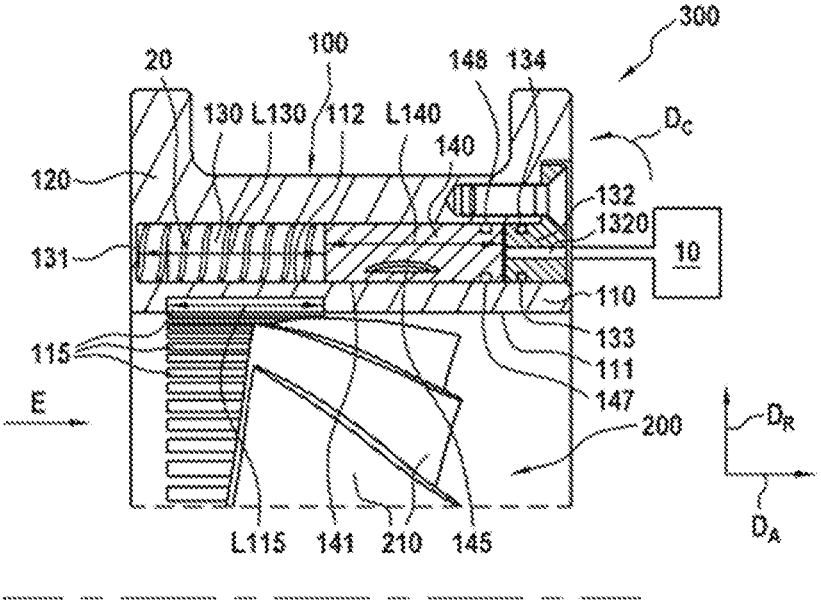
[Fig. 2]
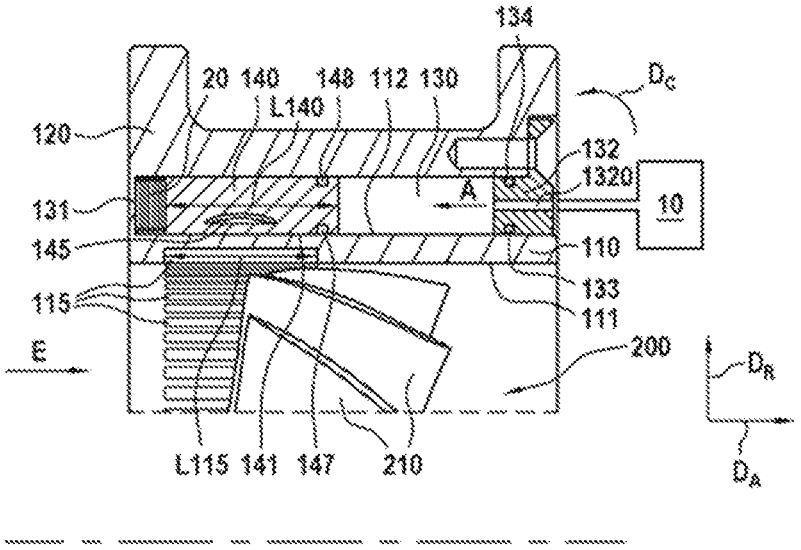

[Fig. 3]
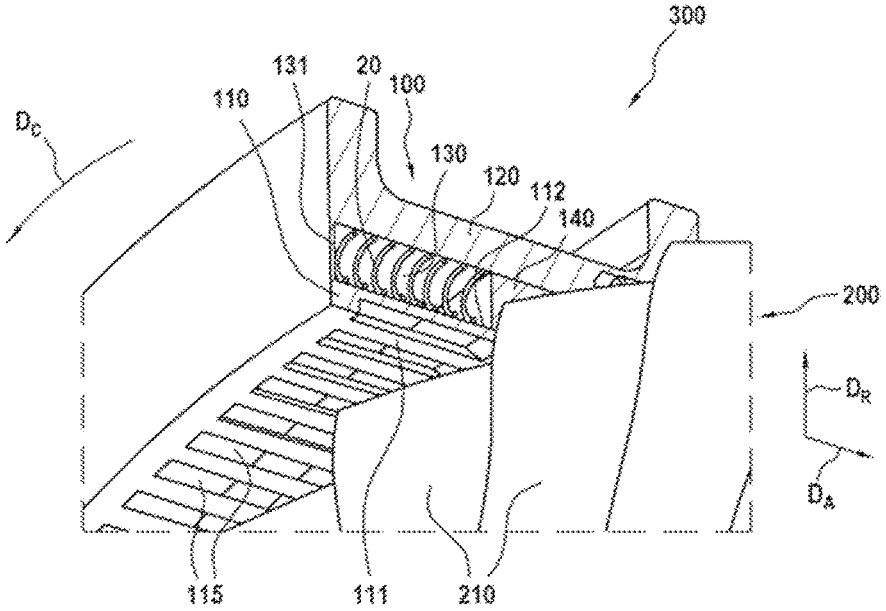
[Fig. 4]
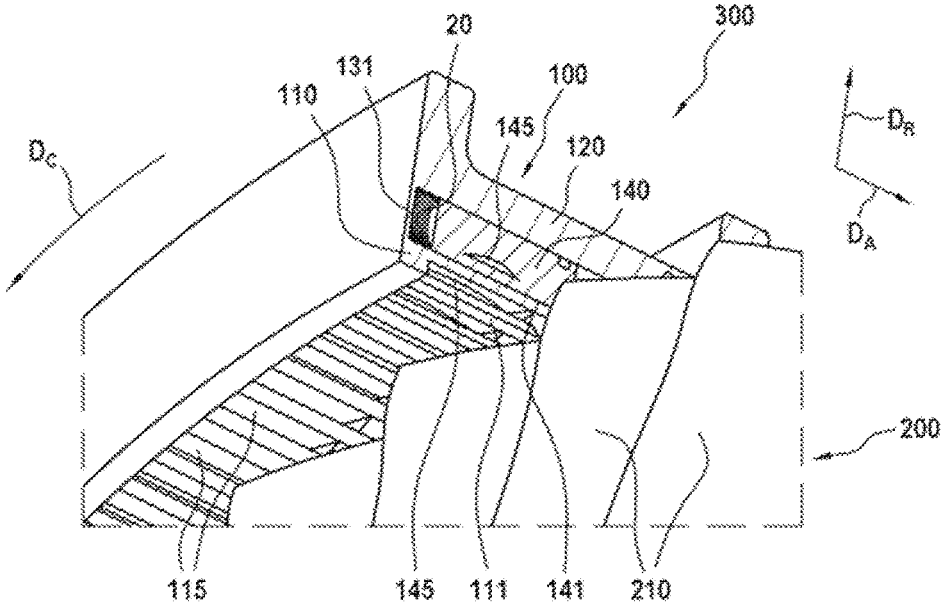

[Fig. 5]
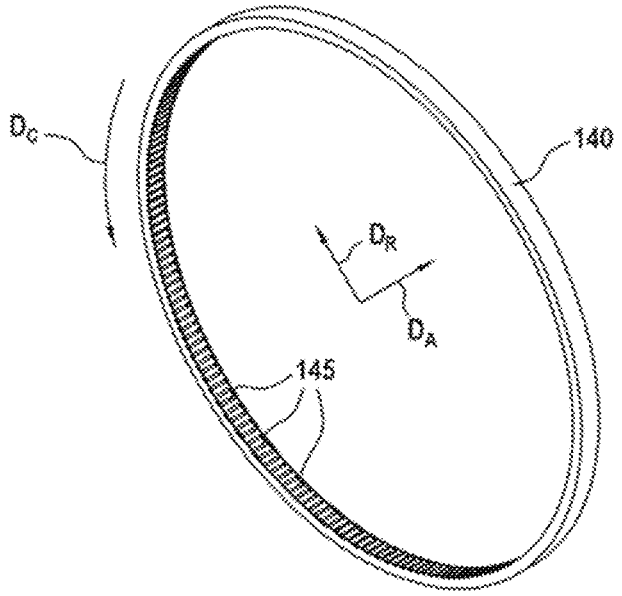
[Fig. 6]
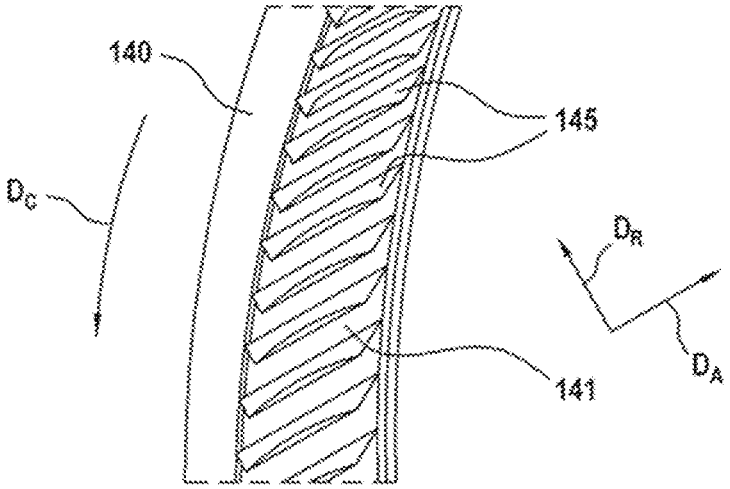

TREATMENT OF A NON-AXISYMMETRIC CASING COMPRISING A PLENUM, WITH CONTROLLED OPENING

CROSS-REFERENCE TO RELATED APPLICATIONS

This is a National Stage Application under 35 U.S.C. § 371 of International Application No. PCT/FR2024/050055, filed Jan. 15, 2024, now published as WO 2024/153880 A1, which claims priority to French Patent Application No. 2300514, filed on Jan. 19, 2023, the entireties of which are incorporated herein by reference.

TECHNICAL FIELD

This disclosure relates to the general field of turbine engine compressors, and more particularly to treatment of the compressor casing of a turbine engine.

PRIOR ART

Turbine engine compressors are composed of blades set in rotation inside a casing which seals the airflow from the outer surround of the engine.

It is known that the clearance existing between the tips of the mobile compressor blades and the casing forming the inner wall of the airflow degrades the efficiency of the turbine engine.

In addition, this clearance can modify and degrade the operation of the compressor up until the onset of a phenomenon known as compressor stall resulting from disruption of airflow on the surface of the blades. Control over the circulation of air at the tips of the blades amounts to a major challenge for the obtaining both of good aerodynamic efficiency of the compressor and a sufficient margin against the phenomenon of compressor stall.

To limit the impact of this parasitic flow between the tips of the blades and the casing, the inner surface of the casing can be locally treated by cutting out slots therein arranged in the thickness of the casing opposite the blades. The casing treatments under consideration in the present invention are of «axial slot» type corresponding to a series of slots arranged along the circumference of the casing (in azimuth direction). These slots are positioned vertically («above») a compressor wheel. Such treatment is therefore non-axisymmetric in relation to the rotational axis of the compressor: it is therefore non-axisymmetric casing treatment or NACT.

With the presence of these slots, the flow will be locally modified. The objective is to impact the onset of mechanisms responsible for the emergence of compressor stall. Efficient casing treatment will increase the range of compressor operability by delaying the onset of these mechanisms, in particular by reducing aerodynamic blockage at the wheel head.

Some NACT designs propose adding an annular cavity or «plenum» in the casing as described for example in document WO9420759, which amounts to adding a cavity above the slots. This cavity extends over the entire circumference of the casing joining the slots together. This cavity is not directly opened onto the airflow and is not connected to a secondary air circuit. The flow must therefore pass through the slots to enter and leave the cavity. The adding of the plenum tends to amplify the capability of NACT to increase the stall margin.

The presence of the annular cavity (plenum) with NACT is not necessarily advantageous at all operating speeds. At some speeds, the slots are sufficient to ensure operability. In addition, the cavity necessarily has its own acoustic modes. If these own modes are excited, phenomena of acoustic resonance may appear leading to compressor stall. Also, for some compressors and at some operating speeds, NACT without all or part of the annular cavity can provide better efficiency than NACT with annular cavity.

It is therefore desirable to make available a compressor casing having several NACT configurations, namely a casing in which communication between the slots and annular cavity can be controlled.

DESCRIPTION OF THE INVENTION

For this purpose, the invention proposes a casing of a turbine engine compressor comprising an inner annular wall and an outer annular wall delimiting therebetween an annular cavity, the inner annular wall of the casing comprising a plurality of slots hollowed out in the thickness of the inner annular wall, the slots being arranged next to one another in a circumferential direction and each extending in an axial direction, characterised in that the casing further comprises a sliding ring in the annular cavity of said casing, the sliding ring being movable in the axial direction between an open position in which the slots in the inner annular wall of the casing open into the annular cavity, and a closed position in which the sliding ring covers at least some slots such that they do not open into the annular cavity, the casing additionally comprising an actuating device to move the sliding ring between the open and closed positions.

With the casing of the invention, it is therefore possible to optimise non-axisymmetric casing treatment according to the operative ranges of the compressor. For operating speeds which so require, the sliding ring is placed in open position to obtain the benefit of an extra stall margin whereby the slots of the casing are able to open into the annular cavity or plenum. At speeds or operating ranges for which the effect of the casing slots is alone sufficient for treatment, the sliding ring is placed in closed position, which in particular allows the preventing of acoustic modes which may develop in the annular cavity and which are particularly dependent on rotational speed.

The use of a sliding ring in the annular cavity of the casing additionally affords an optimised integrated solution for compressor casings, while limiting an increase in the overall mass of the casing and ensuring the structural strength of the casing assembly.

In one particular characteristic of the invention, the sliding ring is formed of a single piece. In this case, the actuating device may comprise a pressurised air injection system communicating with one or more injection orifices provided in the downstream end part of the annular cavity, a plurality of springs being held under compression between an upstream end part of the annular cavity and the sliding ring.

In another particular characteristic of the invention, the sliding ring is divided into several annular segments able to slide individually within the annular cavity in the axial direction. This allows selective control over closing of the slots of the casing and reduces the volume of the cavity for operating speeds at which a reduced plenum volume is useful. In this case, the actuating device comprises a pressurised air injection system communicating with at least one injection orifice provided in the downstream end part of the annular cavity opposite each annular segment of the sliding ring, at least one spring being held under compression between an upstream end part of the annular cavity and each annular segment of the sliding ring.

In another particular characteristic of the invention, the sliding ring comprises cavities on the inner surface thereof lying opposite the outer surface of the inner annular wall, the cavities being positioned on the inner surface of the sliding ring at determined points such that the cavities coincide with the slots in the closed position. The cavities of the sliding ring can be aerodynamically shaped e.g. of half-moon shape, imparting an aerodynamic shape to the slots and thereby limiting losses.

In another particular characteristic of the invention, the openings of the movable ring and the slots of the casing have the same dimensions.

The invention also concerns a turbine engine compressor comprising a casing of the invention.

BRIEF DESCRIPTION OF THE DRAWINGS

Other characteristics and advantages of the present invention will become apparent from the description given below with reference to the appended drawings illustrating examples of embodiment that are nonlimiting.

FIG. 1 is a partial, schematic view of a turbine engine compressor with a casing equipped with a sliding ring in open position, according to one embodiment of the invention.

FIG. 2 is a partial, schematic view of a turbine engine compressor with a casing equipped with a sliding ring in closed position, according to one embodiment of the invention.

FIG. 3 is an inclined view of the compressor in FIG. 1.

FIG. 4 is an inclined view of the compressor in FIG. 2.

FIG. 5 is a perspective, schematic view of the sliding ring in the casing of the compressor in FIGS. 1 to 4.

FIG. 6 is a detailed view of part of the sliding ring in FIG. 5.

DESCRIPTION OF EMBODIMENTS

FIGS. 1 to 4, partially and schematically, illustrate a turbine engine compressor 300 in one embodiment of the invention. The compressor 300 comprises a rotor 200 equipped with a plurality of blades 210 surrounded by a casing 100.

The casing 100 comprises an inner annular wall 110 and an outer annular wall 120 each extending lengthwise in a circumferential direction Dc, widthwise in an axial direction DA and with thickness in a radial direction DR. The inner annular wall 110 and outer annular wall 120 delimit therebetween an annular cavity 130 forming a plenum.

The inner annular wall 110 comprises a plurality of slots 115 hollowed out (or cut) in the thickness of the wall, each slot 115 opens both onto the inner surface 111 and onto the outer surface 112 of the inner annular wall to place an airflow E in communication with the annular cavity 130, the arrow E indicating the direction of flow in the compressor and hence the upstream and downstream sides thereof.

The slots 115 are uniformly arranged next to each other in the inner annular wall 110 in the circumferential direction Dc. Each slot 115 extends over a determined length L115 in the axial direction DA. In the example described here, the slots 115 are inclined at 45° relative to the radial direction DR.

As is known the slots 115, and the annular cavity 130 into which they open, form a non-axisymmetric casing treatment or NACT, allowing local modifying of the airflow to reduce the mechanisms responsible for the onset of compressor stall.

In the invention, the casing 100 additionally comprises a sliding ring 140 contained in the annular cavity 130 and illustrated in full in FIG. 6. The sliding ring 140 is movable in the axial direction DA between an open position in which the slots 115 in the inner annular wall 110 of the casing open into the annular cavity 130 (FIGS. 1 and 3), and a closed position in which the sliding ring covers at least some of the slots 115 (FIGS. 2 and 4). In the closed position, the slots covered by the sliding ring do not open into the annular cavity.

More specifically, the sliding ring 140 moves along the outer surface 112 of the inner annular wall 110 in the axial direction DA. The sliding ring 140 in the axial direction has a length L140 greater than or equal to the length L115 of the slots. The length L140 of the ring 140 is also determined such that the annular cavity 130 extends in the axial direction DA over a length L130 substantially equivalent to length L115 of the slots 115 when the sliding ring is in the open position (FIG. 1).

In the example described here, the sliding ring 140 is in one piece, which means that in the closed position the ring covers all the slots 115 of the inner annular wall 110. In this case, no slot opens into the annular cavity 130.

In one particular characteristic, the sliding ring 140 comprises cavities 145 on the inner surface thereof 141 opposite the outer surface 112 of the inner annular wall 110. The cavities 145 are positioned on the inner surface 141 of the sliding ring at determined points such that the cavities 145 coincide with the slots 115 in the closed position. In the example described here, the cavities 145 are oriented at 45° similar to the slots 115.

The cavities 145 can be of diverse shapes. In particular, they can have an aerodynamic shape such as a half-moon shape as illustrated in FIG. 6. In closed position, the sliding ring 140 provided with cavities 145 allows the imparting of aerodynamic shapes to the slots, thereby limiting losses.

The annular cavity 130 is closed on the upstream side by an upstream end part 131 joined to the inner and outer annular walls 110 and 120, and on the downstream side by a removable downstream flange or end part 132. The removable flange 132 comprises one or more injection orifices 1320 opening into the annular cavity 130 opposite a downstream face 143 of the sliding ring 140.

The casing 100 comprises an actuating device here formed by an air injection system 10 connected to each injection orifice 1320. The injection of a pressurised airflow A via each orifice 1320 controls the movement of the sliding ring 140 to the closed position (FIG. 2). The removable flange 132 is provided with O-rings 133 and 134 to ensure a seal between the airflow and outer surround. Similarly, the sliding ring 140 is provided with O-rings 147 and 148 to ensure a seal between the ring and outer surround.

Additionally, several recoil springs 20 are held under compression between the upstream end part 131 of the annular cavity 130 and upstream surface 144 of the sliding ring 140. The recoil springs 20 are uniformly distributed within the annular cavity 130 in the circumferential direction Dc. The recoil springs 20 allow the sliding ring to be held in the open position for as long as no pressurised air is injected via the injection orifices 1320.

In one variant of embodiment, the sliding ring can be divided into several annular segments able to slide individually in the annular cavity in the axial direction. In this case, the downstream end part or flange comprises at least one injection orifice opposite each annular segment. The actuating device still comprises an air injection system but it is selectively connected e.g. by means of valves to each injection orifice so that pressurised air can be injected independently for each annular segment. In addition, each annular segment is able to slide in guide rails on the outer surface of the inner annular wall and/or on the inner surface of the outer annular wall of the casing. When the ring is provided with cavities, each annular segment comprises a number of cavities corresponding to the number of slots in that part of the inner annular wall to be covered.

It is therefore possible, via selective injection of pressurised air, to control movement of only some of the annular segments toward the closed position, the other annular segments being held in the open position by the recoil springs.

The actuating device is not limited to the use of a pressurised air injection system. The actuating device can also use pistons or cylinders housed in the removable flange 132, or any other suitable actuating system.

Irrespective of embodiment, the slots of the casing can all be the same.

Irrespective of embodiment, the cavities of the sliding ring can all be the same. Advantageously, the cavities of the sliding ring and the slots of the casing are the same size i.e. they have the same length and same width; and the distance between the slots of the casing is equal to the distance between the associated cavities of the sliding ring. This allows the cavities of the sliding ring to coincide with the slots of the casing.

Irrespective of embodiment, the casing can be in one piece.

Irrespective of embodiment, the number of slots in the casing (and hence the number of cavities in the sliding ring) is between 40 and 850, for example between 45 and 810, for example between 60 and 210. The casing treatment requires between 3 and 8 slots per rotor blade and a rotor comprises between 15 and 90 blades. With this range of values, it is therefore possible to cover all possibilities.

Irrespective of embodiment, the casing and sliding ring can be formed of the same material. This allows the two parts to undergo the same thermal and mechanical stresses, thereby ensuring that the opening or closing of the casing slots will always remain possible even in the event of thermal expansion.

Alternatively, the casing and sliding ring can be made of different materials, but these two materials must have close or even the same physical properties so that they undergo similar thermal expansion.

The expression «between . . . and . . . » is to be construed as including the limits.

The invention claimed is:

1. A casing of a turbine engine compressor comprising an inner annular wall and an outer annular wall delimiting therebetween an annular cavity, the inner annular wall of the casing comprising a plurality of slots hollowed out in the thickness of the inner annular wall, the slots being arranged next to one another in a circumferential direction and each extending in an axial direction, the casing further comprising a sliding ring present in the annular cavity of said casing, the sliding ring being movable in the axial direction between an open position in which said slots in the inner annular wall of the casing open into the annular cavity and a closed position in which the sliding ring covers at least some slots, the casing additionally comprising an actuating device to move the sliding ring between the open and closed positions, wherein the sliding ring comprises cavities on the inner surface thereof opposite the outer surface of the inner annular wall, the cavities being positioned on the inner surface of the sliding ring at determined points such that the cavities coincide with the slots in the closed position.

2. The casing according to claim 1, wherein the sliding ring is formed of one piece.

3. The casing according to claim 2, wherein the actuating device comprises a pressurised air injection system communicating with one or more injection orifices in the downstream end part of the annular cavity, a plurality of springs being held under compression between an upstream end part of the annular cavity and the sliding ring.

4. The casing according to claim 1, wherein the sliding ring is divided into several annular segments able to slide individually within the annular cavity in the axial direction.

5. The casing according to claim 4, wherein the actuating device comprises a pressurised air injection system communicating with at least one injection orifice provided in the downstream end part of the annular cavity opposite each annular segment of the sliding ring, at least one spring being held under compression between an upstream end part of the annular cavity and each annular segment of the sliding ring.

6. The casing according to claim 1, wherein the cavities of the sliding ring have an aerodynamic shape.

7. The casing according to claim 1, wherein the cavities of the sliding ring and the slots of the casing have the same dimensions.

8. A turbine engine compressor comprising the casing according to claim 1.

* * * * *